US008479527B2

(12) United States Patent
Song et al.

(10) Patent No.: US 8,479,527 B2
(45) Date of Patent: Jul. 9, 2013

(54) REFRIGERATOR AND CONTROL METHOD FOR THE SAME

(75) Inventors: Gye Young Song, Seoul (KR); Kwang Woon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 431 days.

(21) Appl. No.: 12/741,295

(22) PCT Filed: Oct. 28, 2008

(86) PCT No.: PCT/KR2008/006343

§ 371 (c)(1),
(2), (4) Date: Jul. 22, 2010

(87) PCT Pub. No.: WO2009/061094

PCT Pub. Date: May 14, 2009

(65) Prior Publication Data

US 2010/0287961 A1 Nov. 18, 2010

(30) Foreign Application Priority Data

Nov. 5, 2007 (KR) ..... 10-2007-0112328

(51) Int. Cl.
*F25B 41/00* (2006.01)

(52) U.S. Cl.
USPC ..... 62/81; 62/151; 62/234

(58) Field of Classification Search
USPC ..... 62/81, 80, 151, 234, 441, 197, 199
See application file for complete search history.

(56) References Cited

U.S. PATENT DOCUMENTS

| | | | | |
|---|---|---|---|---|
| 4,522,037 | A * | 6/1985 | Ares et al. | 62/196.4 |
| 4,648,247 | A | 3/1987 | Takizawa et al. | 62/256 |
| 4,681,297 | A * | 7/1987 | Mertz | 251/45 |
| 4,741,171 | A | 5/1988 | Toshiyuki | |
| 5,187,945 | A * | 2/1993 | Dixon | 62/234 |
| 5,323,621 | A * | 6/1994 | Subera et al. | 62/196.4 |
| 5,339,644 | A * | 8/1994 | Singh | 62/234 |
| 5,755,104 | A * | 5/1998 | Rafalovich et al. | 62/81 |
| 6,196,007 | B1 * | 3/2001 | Schlosser et al. | 62/73 |
| 6,705,107 | B2 * | 3/2004 | Schlosser et al. | 62/344 |

FOREIGN PATENT DOCUMENTS

| | | |
|---|---|---|
| DE | 20 2005 006 284 U1 | 6/2005 |
| GB | 2 168 137 A | 6/1986 |
| JP | 04-356677 | 12/1992 |
| JP | 2003-329354 | 11/2003 |
| KR | 10-0182726 | 5/1999 |

OTHER PUBLICATIONS

International Search Report issued in PCT/KR2008/006343 dated Apr. 14, 2010.
European Search Repot dated Jan. 19, 2012 issued in Application No. 08 84 7930.

* cited by examiner

*Primary Examiner* — Mohammad M Ali
(74) *Attorney, Agent, or Firm* — KED & Associates, LLP

(57) ABSTRACT

A refrigerator and a control method of the same are disclosed. A refrigerator includes a plurality of evaporators and a refrigerant path conversion device connected with the plurality of the evaporates, the refrigerant path conversion device controlling a path of refrigerant to perform defrosting operations for predetermined evaporators and cooling operations for the other evaporators.

17 Claims, 3 Drawing Sheets

REFRIGERATOR AND CONTROL METHOD FOR THE SAME

TECHNICAL FIELD

The present invention relates to a refrigerator. More specifically, the present invention relates to a refrigerator and a control method of the same, which can simultaneously perform a defrosting operation for a freezing compartment evaporator of and a cool air generating operation for a refrigerating compartment, with a reduced electricity consumption and high efficiency of a freezing cycle.

BACKGROUND ART

Refrigerators are appliances used to freeze or preserve food items fresh.

FIG. 1 is a diagram illustrating a freezing cycle of a conventional refrigerator.

As shown in FIG. 1, the freezing cycle includes a compressor 10 and a condenser 20. A 3-way valve 30 is installed at a rear end of the condenser 20 and two pipes 31 and 32 are connected with the 3-way valve 30 in parallel.

At the first pipe 31 may be installed a first expansion device 35 and a refrigerating compartment evaporator 50. At the second pipe 32 may be installed a second expansion device 45 and a freezing compartment evaporator 60.

The evaporator 50 is installed in the refrigerating compartment to generate and supply cool air to the refrigerating compartment. The evaporator 60 is installed in the freezing compartment to generate and supply cool air to the freezing compartment.

If both the freezing and refrigerating compartments are put into operation, refrigerant discharged from the compressor 10 is condensed at the condenser 20 and then the refrigerant is flowing to both of the first and second pipes 31 and 32 from the 3-way vale 30, such that the refrigerant is expanded at the first and the second expansion devices 35 and 45. Hence, the refrigerant is evaporated at the refrigerating compartment evaporator 50 and the freezing compartment evaporator 60 and then cool air is generated to be supplied to the refrigerating and freezing compartments.

During the operation of the refrigerator, much moisture is generated within the refrigerator and such the moisture might be flowing along the circulating cool air only to be conceived in the evaporator having a low temperature. As a result, a problem of deteriorated heat-exchange efficiency in the evaporators might arise.

To remove frost formed in the evaporator, as shown in FIG. 1, a heater is installed at a rear end of the evaporator to heighten the temperature near the evaporator. If the power is applied to the heater, the frost generated in the evaporator is removed by the heat generated by an electric wire.

DISCLOSURE OF INVENTION

Technical Problem

However, the conventional refrigerator might have following problems.

First, power should be consumed more in the conventional refrigerator, because the auxiliary heater should be provided. In addition, the temperature in the refrigerator is getting higher because of the heat generated by the heater. As a result, an auxiliary cooling operation should be performed, only to deteriorate freezing efficiency.

Furthermore, while the evaporator for the freezing compartment is defrosted by using the heater, the refrigerating compartment evaporator cannot be operated in the conventional refrigerator. As a result, refrigerator efficiency may deteriorate.

Technical Solution

To solve the problems, an object of the present invention is to provide a refrigerator capable of simultaneously performing a defrosting operation for a freezing compartment evaporator and a cooling operation for a refrigerating compartment evaporator to enhance refrigeration efficiency.

To achieve these objects and other advantages and in accordance with the purpose of the invention, as embodied and broadly described herein, a refrigerator includes a plurality of evaporators; and a refrigerant path conversion device connected with the plurality of the evaporates, the refrigerant path conversion device controlling a path of refrigerant to perform defrosting operations for predetermined evaporators and cooling operations for the other evaporators.

The plurality of the evaporators may include a refrigerating compartment evaporator; and a freezing compartment evaporator. The refrigerant path conversion device may include a first refrigerant path control valve controlling the path of the refrigerant drawn into the refrigerating compartment evaporator and the freezing compartment evaporator; and a first bypass pipe provided between the first refrigerant path control valve and the freezing compartment evaporator to guide the refrigerant having passed the first refrigerant path control valve, without being expanded, to the freezing compartment evaporator.

The first bypass pipe may be provided between the first refrigerant path control valve and the freezing compartment evaporator, in parallel with a freezing compartment expansion device expanding the refrigerant drawn into the freezing compartment evaporator.

The refrigerant path conversion device may further include a second bypass pipe provided between the freezing compartment evaporator and the refrigerating compartment expansion device expanding the refrigerant drawn into the refrigerating compartment evaporator to guide the refrigerant discharged from the freezing compartment evaporator to the refrigerating compartment expansion device.

The refrigerant path conversion device may further include a second refrigerant path control valve connected with the second bypass pipe to close the refrigerant flowing to the second bypass pipe selectively.

an end of the second bypass pipe may be connected with the second refrigerant path control valve and the other end of the second bypass pipe may be connected between the first refrigerant path control valve and the refrigerating compartment expansion device.

The second refrigerant path control valve may be a 3-way valve guiding the refrigerant discharged from the evaporator of the freezing compartment toward the second bypass pipe and a compressor selectively.

The first refrigerant path control valve may be a 4-way valve.

In another aspect, a refrigerator includes a refrigerating compartment evaporator generating cool air drawn into a refrigerating compartment; a freezing compartment evaporator generating cool air drawn into a freezing compartment; and a refrigerant path conversion device controlling a flow direction of the refrigerant drawn into the refrigerating compartment evaporator and the freezing compartment evaporator to perform a defrosting operation for the freezing compartment evaporator and a cool air generation operation for the refrigerating compartment evaporator.

The refrigerator may further include a refrigerating compartment expansion device expanding the refrigerant drawn into the refrigerator compartment evaporator; a freezing compartment expansion device expanding the refrigerant drawn into the freezing compartment evaporator. Here, the refrigerant conversion device may include a first refrigerant path control valve controlling the refrigerant to selectively flow to the refrigerating compartment expansion device and the freezing compartment expansion device selectively; and a first bypass pipe provided between the first refrigerant path control valve and the freezing compartment evaporator, in parallel with a freezing compartment expansion device, to guide the refrigerant to the refrigerating compartment evaporator, without the refrigerant passing the freezing compartment expansion device, such that the refrigerant performs a defrosting operation for the freezing compartment evaporator.

The refrigerant path conversion device may further include a second bypass pipe provided between the freezing compartment evaporator and the refrigerating compartment expansion device to guide the refrigerant discharged from the freezing compartment evaporator toward the refrigerating compartment expansion device; and a second refrigerant path control valve connected with the second bypass pipe to close the path of the refrigerant guided by the second bypass pipe selectively.

The first refrigerant path control valve may be a 4-way valve and the second refrigerant path control valve may be a 3-way valve.

In a still further aspect, a control method of a refrigerator includes determining whether a cool air generation operation for a plurality of evaporators is performed or both a cool air generation operation and a defrosting operation are performed simultaneously; expanding and guiding the refrigerant toward an evaporator, which is an object of the cool air generation operation, after drawing refrigerant into an evaporator which is an object of the defrosting operation without the refrigerant being expanded, if it is determined that both the cool air generation operation and the defrosting operation are performed simultaneously.

The refrigerant discharged from the evaporator which is the object of the cool air generation operation may be expanded by an expansion device and the refrigerant may be drawn into the evaporator which is the object of the cool air generation operation.

The refrigerant drawn into the evaporator which is the object of the defrosting operation may pass a condenser and the refrigerant, without passing an expansion device, may be bypassed toward the evaporator which is the object of the defrosting operation.

In the control method of the refrigerator comprising the plurality of the evaporators comprises a freezing compartment evaporator and a refrigerating compartment evaporator; a first refrigerant path control valve provided at a branched portion between a pipe connected with a freezing compartment expansion device connected with the freezing compartment evaporator and a refrigerating expansion device connected with the refrigerating compartment evaporator; a first bypass pipe connected with the first refrigerant path control valve, in parallel with the freezing compartment expansion device to guide the refrigerant having passed the first refrigerant path control valve toward the freezing compartment evaporator, without being expanded; a second bypass pipe provided between an outlet pipe of the freezing compartment evaporator and an inlet pipe of the refrigerating compartment expansion device to guide the refrigerant discharged from the freezing compartment evaporator toward the refrigerating compartment expansion device; a second refrigerant path control valve provided at a connection portion between the second bypass pipe and the outlet pipe of the freezing compartment evaporator to close a flow of the refrigerant selectively, if the cool air generation operation and the defrosting operation are performed simultaneously, the first refrigerant path control valves may control the condensed refrigerant toward the first bypass pipe to perform the defrosting operation for the evaporator and the second refrigerant path control valve may control the refrigerant discharged from the freezing compartment toward the second bypass pipe.

If only the cool air generation device for the freezing compartment evaporator is performed, the first path control valve may control the refrigerant toward the freezing compartment expansion device, closing the flow of the refrigerant toward the refrigerating compartment expansion device, and the second refrigerant path control valve may control the refrigerant discharged from the freezing compartment evaporator toward the compressor, closing the flow of the refrigerator toward the second bypass pipe.

If only the cool air generation for the refrigerating compartment evaporator is performed, the first refrigerant path control valve may control the refrigerant toward the refrigerating compartment expansion device, closing the flow of the refrigerant toward the freezing compartment expansion device and the second bypass pipe.

If the cool air generation operations for both refrigerating compartment evaporator and the freezing compartment refrigerator are performed simultaneously, the first refrigerant path control valve may control the refrigerant toward the freezing compartment expansion device and the second refrigerant path control valve may control the refrigerant discharged from the freezing compartment evaporator to flow toward the second bypass pipe.

Advantageous Effects

The present invention has following advantageous effects.

First, the defrosting operation for the freezing compartment evaporator and the cool air generation operation for the refrigerating compartment can be performed simultaneously. As a result, operational efficiency of the refrigerator can be enhanced.

Further more, the evaporator is defrosted by using only refrigerant, without any auxiliary defrosting operations. As a result, electricity consumption could be reduced, without any additional electricity.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

FIG. illustrates a freezing cycle of a refrigerator according to an exemplary embodiment.

Figure 1:
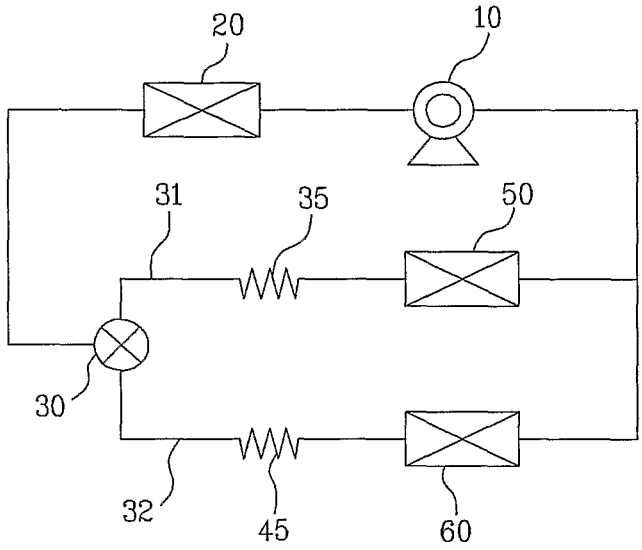
FIG. 1 is a diagram schematically illustrating a freezing cycle of a conventional refrigerator.
Figure 2:
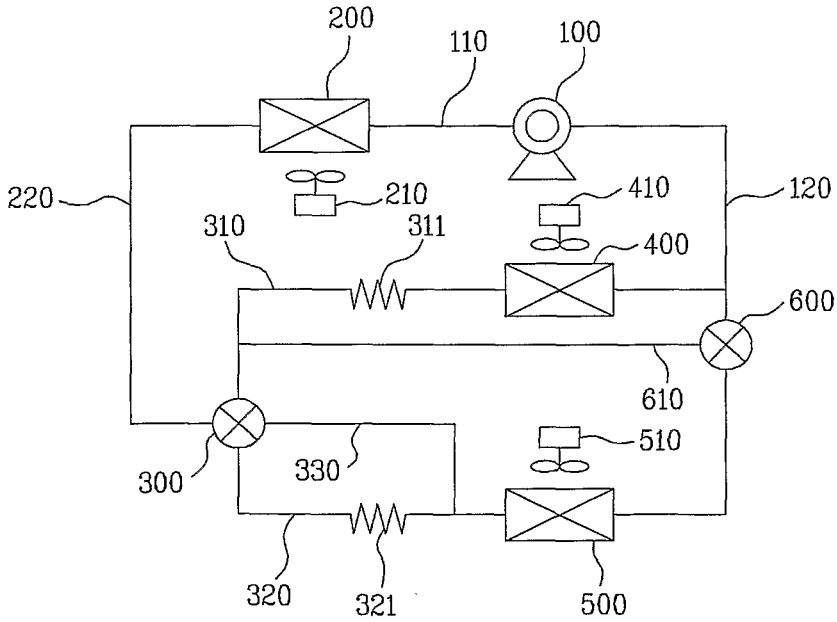
FIG. 2 is a diagram schematically illustrating a freezing cycle of a refrigerator according to an exemplary embodiment.

As shown in FIG. 2, the refrigerator according to the exemplary embodiment includes a compressor 100, a condensing device, a refrigerating compartment evaporator 400, a freezing compartment evaporator 500 and a refrigerant path conversion device. The compressor 100 compresses and discharges refrigerant. The condensing device condenses the refrigerant discharged from the compressor 100. The refrigerating compartment evaporator 400 cools the refrigerating compartment. The freezing compartment evaporator 500 is connected with the refrigerating compartment evaporator 400 in parallel and it cools the freezing compartment. The refrigerant path conversion device enables a defrosting operation for the freezing compartment evaporator 500 and a cool-air-generating operation for the refrigerating compartment evaporator 400 to be performed simultaneously.

Here, refrigerant at a low pressure and low temperature is compressed into refrigerant at a high pressure and high temperature. The compressed high pressure/high temperature refrigerant passes the condensing device and it is cool-condensed, such that the refrigerant is converted into a high temperature fluidal material.

The condensing device is connected with the compressor via an outlet pipe 110 where the refrigerant discharged from the compressor is flowing. The condensing device includes a condenser 200 condensing the high pressure/high temperature refrigerant by the heat exchange and a condensing fan 210 blowing ambient air to pass the condenser 200, such that the refrigerant is heat-exchanged with the ambient air at the condenser 200.

The refrigerant path conversion device includes a first refrigerant path control valve 300, a first bypass pipe 330 and a second bypass pipe 610. The first refrigerant path control valve 300 is installed at a portion, where the refrigerant having passed the condenser 200, is branched toward both of the evaporators 400 and 500 to control the flow of the refrigerant. The first bypass pipe 330 directly guides the refrigerant having passed the first refrigerant path control valve 300 to the freezing compartment evaporator 500. The second bypass pipe 610 guides the refrigerant having passed the freezing compartment evaporator 500 to the refrigerating compartment expansion device 311.

The refrigerant path conversion device may further include a second refrigerant path control valve 600 capable of selectively controlling the refrigerant having passed the freezing compartment evaporator 500 to either of the second bypass pipe 610 and the compressor 100.

The refrigerant path conversion device enables to be selectively or simultaneously performed the cooling operation for the refrigerating compartment or the freezing compartment and the defrosting operation for the freezing compartment evaporator 500, only to perform various operational modes.

The operational modes are configured of a first operational mode, a second operational mode, a third operational mode and a fourth operational mode. In the first operational mode, only the refrigerating compartment is operated. In the second operational mode, only the freezing compartment is operated. In the third operational mode, both the refrigerating compartment and the freezing compartment are operated. In the fourth operational mode, the defrosting operation of the freezing compartment evaporator and the operation of the refrigerating compartment are performed simultaneously.

In the meantime, the first refrigerant path control valve 300 is connected with the condenser 200 via a high pressure pipe 220 to convert the flow path of the refrigerant. The first refrigerant path control valve 300 is connected with the first refrigerant pipe 310, the second refrigerant path 320 and the first bypass pipe 330.

Here, the first refrigerant path control valve 300 is a 4-way valve and it is determined according to the operational modes which direction the refrigerant is flowing in, for example, toward the first refrigerant pipe 310, the second refrigerant pipe 320 or the first bypass pipe 330.

At the first refrigerant pipe 310 may be installed serially the refrigerating compartment expansion device 311 and the refrigerating compartment evaporator 400. At the second refrigerant pipe 320 may be installed serially the freezing compartment expansion device 321 and the freezing compartment evaporator 500. At this time, the first refrigerant pipe 310 and the second refrigerant pipe 320 are connected with each other in parallel.

The first bypass pipe 330 is in parallel with the freezing compartment expansion device 321 installed at the second refrigerant pipe 320, to guide the refrigerant having passed the first refrigerant path control valve 300 to be drawn into the freezing compartment evaporator 500, without an expansion process.

That is, the first bypass pipe 330 is provided between the first refrigerant path control valve 300 and the freezing compartment evaporator 400.

During the cooling operation for the freezing compartment, the refrigerant expanded after passing the freezing compartment expansion device 321 may be evaporated by the heat exchange. At this time, a second fan 510 may be further provided to blow ambient air to pass the freezing compartment evaporator 500 to heat-exchange with the refrigerant of the freezing compartment evaporator 500, such that refrigerant of the freezing compartment evaporator 500 may heat-exchange with the ambient air.

In addition, during the defrosting operation for the freezing compartment evaporator 500, the high temperature refrigerant having passed the first refrigerant path control valve 300 and the first bypass pipe 330 defrosts the freezing compartment evaporator 500.

The freezing compartment evaporator 500 is connected with the compressor via a return pipe 120. The return pipe 120 is connected with the second bypass pipe 610 guiding the refrigerant having passed the freezing compartment evaporator 500 to the refrigerating compartment expansion device 311.

The second refrigerant path control valve 600 is installed at the return pipe 120 to guide the refrigerant having passed the freezing compartment evaporator 500 toward either of the second bypass pipe 610 and the compressor 100 selectively.

Here, an end of the second bypass pipe 610 is connected with the second refrigerant path control valve 600 and the other end of the second bypass pipe 610 is connected between the first refrigerant path control valve 300 and the expansion device 311.

The second refrigerant path control valve 600 connected with the second bypass pipe 610 and the return pipe 120 is a 3-way valve.

The refrigerating compartment evaporator 400 further includes a first fin unit 410 to evaporate the refrigerant, which is expanded after passing the refrigerating compartment expansion device 311, and to blow ambient air to pass the refrigerating compartment evaporator 400 such that the refrigerant of the refrigerating compartment evaporator 400 may heat-exchange with the ambient air.

An operation of the refrigerator shown in FIGS. 3 to 6 will be described.

Figure 3:
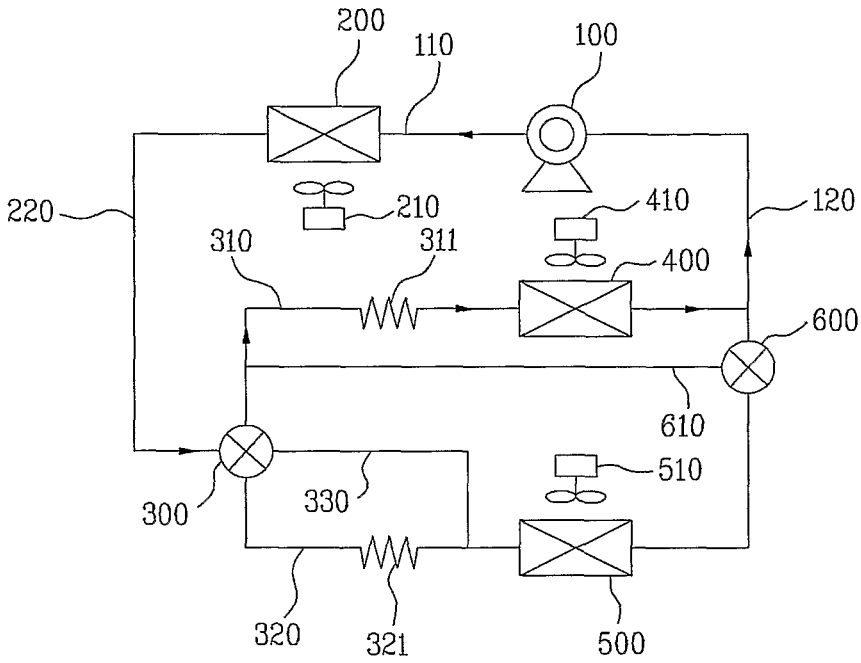
FIG. 3 is a diagram schematically illustrating a freezing cycle if only a refrigerating operation is performed in the refrigerator according to the exemplary embodiment.

As shown in FIG. 3, in the first operational mode, the refrigerant compressed at the compressor 100 is discharged and passes along an outlet pipe 110 to be condensed at the condenser 200. A flow direction of the refrigerant flowing along the high pressure pipe 220 is determined toward the first pipe 310 by the first refrigerant path control valve 300.

Hence, the refrigerant flowing along the first pipe 310 is expanded at the refrigerating compartment expansion device 311 only to be drawn into the refrigerating compartment evaporator 400. The refrigerant is evaporated at the refrigerating compartment evaporator 400 and the first fan unit 410 supplies cool air to the refrigerating compartment. After that, the refrigerant returns to the compressor 100 via the return pipe 120, after passing the refrigerating compartment evaporator 400.

Figure 4:
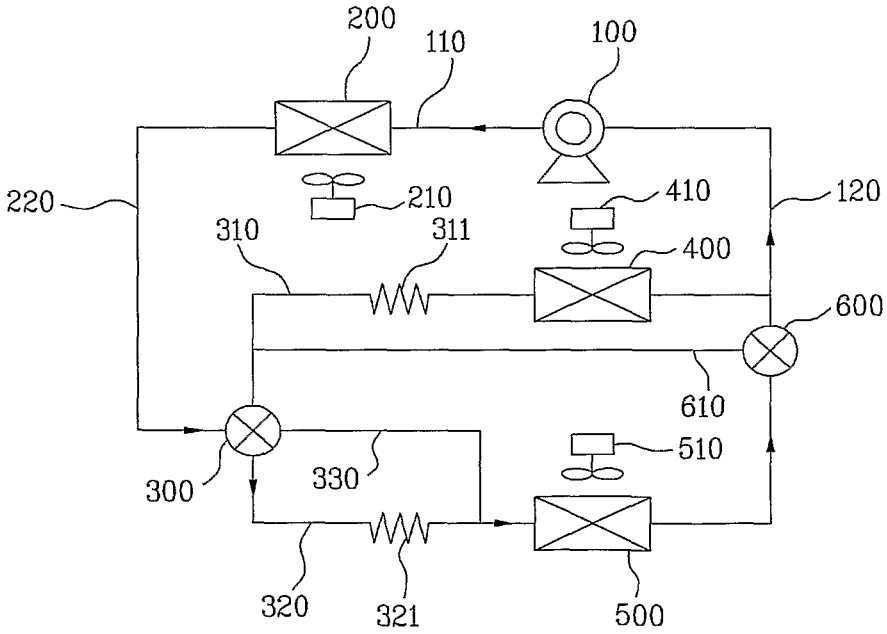
FIG. 4 is a diagram schematically illustrating a freezing cycle if only a freezing operation is performed in the refrigerator according to the exemplary embodiment.

As shown in FIG. 4, in the second operational mode, the refrigerant is discharged after being compressed at the compressor 100 and the refrigerant is flowing along the outlet pipe 110 to be condensed at the condenser 200. A flow direction of the refrigerant flowing along the high pressure pipe 220 is determined toward the second pipe 320 by the first refrigerant path control valve 300.

The refrigerant flowing along the second pipe 320 is expanded at the freezing compartment expansion device 321 to be drawn into the freezing compartment evaporator 500. The refrigerant is evaporated at the freezing compartment evaporator 500 and then the second fan unit 510 supplies cool air to the freezing compartment. After the refrigerant passes the freezing compartment evaporator 500, the flow direction of the refrigerant is determined toward the compressor 100 by the second refrigerant path control valve 600 and the refrigerant returns to the compressor 100 via the return pipe 120.

Figure 5:
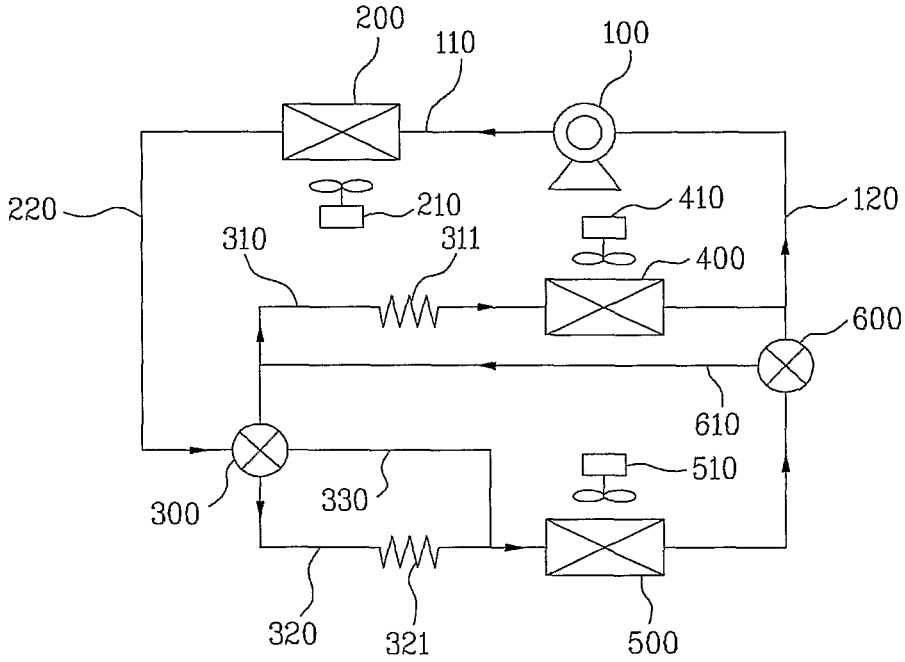
FIG. 5 is a diagram schematically illustrating a freezing cycle if both the refrigerating operation and the freezing operation are performed simultaneously.

As shown in FIG. 5, in the third operational mode, the refrigerant is compressed at the compressor 100 and it is discharged along the outlet pipe 110, only to be condensed at the condenser 200. A flow direction of the refrigerant flowing along the high pressure pipe 220 is determined toward the second pipe 320 by the first refrigerant path control valve 300.

The refrigerant flowing along the second pipe 320 is expanded at the freezing compartment expansion device 321 to be drawn into the freezing compartment evaporator 500. The refrigerant is evaporated at the freezing compartment evaporator 500 and the second fan unit 510 supplies cool air to the freezing compartment. A flow direction of the refrigerant after passing the freezing compartment evaporator 500 is determined toward the second bypass pipe 610 by the second refrigerant path control valve 600.

After the refrigerant flowing along the second bypass pipe 610 passes the first pipe 310, the refrigerant is expanded at the refrigerating compartment expansion device 311 and it is drawn into the refrigerating compartment evaporator 400. The refrigerant is evaporated at the refrigerating compartment evaporator 400 and the first fan unit 410 supplies the cool air to the refrigerating compartment. If then, the refrigerant returns to the compressor 100 via the return pipe 120.

Figure 6:
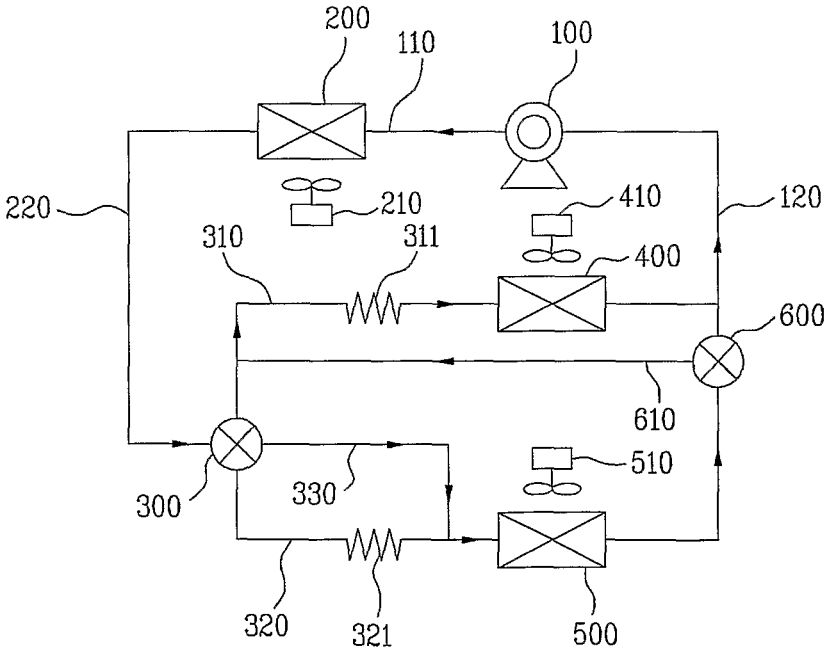
FIG. 6 is a diagram schematically illustrating a freezing cycle if both a defrosting operation and the refrigerating operation are performed simultaneously.

As shown in FIG. 6, in the fourth operational mode, the refrigerant compressed and discharged from the compressor 100 is flowing along the outlet pipe 110 and it is condensed at the condenser 200. The refrigerant flowing along the high pressure pipe 220 toward the freezing compartment expansion device 321 is closed at the first refrigerant path control valve 300 and a flow direction of the refrigerant is determined toward the first bypass pipe 330.

The refrigerant flowing along the first bypass pipe 330 is drawn into the freezing compartment evaporator 500 directly, not passing the freezing compartment expansion device 321. As a result, if the high temperature refrigerant discharged from the condenser 200 is drawn into the freezing compartment evaporator 500 directly, the temperature of the freezing compartment evaporator 500 is substantially getting high and then a frost layer formed at a surface of the evaporator 500 is meld down.

Hence, a flow direction of the refrigerant having passed the freezing compartment evaporator 500 is determined toward the second bypass pipe 610 by the second refrigerant path control valve 600.

The refrigerant flowing along the second bypass pipe 610 passes the first pipe 310 and it is expanded at the refrigerating compartment expansion device 311 to be drawn into the refrigerating compartment evaporator 400. If the refrigerant is evaporated at the refrigerating compartment evaporator 400, the first fan unit 410 supplies cool air to the refrigerating compartment. After that, the refrigerant having passed the refrigerating compartment evaporator 400 returns to the compressor 100 via the return pipe 120.

Accordingly, the refrigerator according to the embodiment is capable of performing both the defrosting operation for the freezing compartment and the refrigerating operation for the refrigerating compartment simultaneously in the fourth operational mode, such that an efficiency of the refrigerator may be enhanced. In addition, the refrigerator according to the embodiment is capable of defrosting the evaporator without any auxiliary defrosting means, such that electricity consumption may be reduced.

Although not shown in the drawings, it is possible in the refrigerator according to the embodiment to perform both the defrosting operation for the refrigerating compartment evaporator and the freezing operation for the freezing compartment simultaneously, by controlling the refrigerant path conversion device.

Next, a control method of the refrigerator described above will be explained.

Although not shown in the drawings, the refrigerator according to the embodiment includes a control part to control the compressor, the condenser and the refrigerant path conversion device which are electrically connected with each other.

First of all, the control part determines in which operational mode the refrigerator is operated and this is determined based on whether a user operates simultaneously or selectively either of the cool air generation operation for the refrigerating compartment and the defrosting operation for the freezing compartment evaporator.

That is, the control part determines whether the operational state of the refrigerator selected by the user at the present is the first operational mode, second operational mode, third operational mode or fourth operational mode.

As shown in FIG. 3, in case of the first operational mode, the control part operates the compressor 100 and the control part controls the refrigerant path conversion device to close the second pipe 320 and to open the first pipe such that the refrigerant may flow to the first pipe 310 to perform the cool air generation operation for the refrigerating compartment.

As shown in FIG. 4, in case of the second operational mode, the control part operates the compressor 100 and it controls the refrigerant conversion device to close the first pipe 310 and to open the second pipe 320, such that the refrigerant may flow to the second pipe 320 and that the freezing operation for the freezing compartment may be performed.

As shown in FIG. 5, in case of the third operational mode, the control part operates the compressor 100 and it controls the refrigerant path conversion device to control the refrigerant toward the first pipe via the second pipe 320 and the second bypass pipe 610, such that the cool air generation operation and the freezing operation may be performed simultaneously.

As shown in FIG. 6, in case of the fourth operational mode, the control part operates the compressor 100 and it controls the refrigerant path conversion device to control the refrigerant to the first pipe 310 via the first bypass pipe 330 and the second bypass pipe 610, such that the defrosting operation and the cool air generation operation may be performed simultaneously.

During such the defrosting operation, the refrigerant path conversion device closes the first pipe 310 and the second pipe 320 and opens the first bypass pipe 330, to control the refrigerant to flow toward the first bypass pipe 330. As a result, the high temperature refrigerant not having passed the freezing compartment expansion device 321 can be guided directly to the freezing compartment evaporator 500 only to defrost the freezing compartment evaporator 500.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

The present invention has an industrial applicability.

It is possible according to the refrigerant and the controlling method of the same to perform both the defrosting operation for the freezing compartment evaporator and the cool air generation operation for the refrigerating compartment simultaneously. As a result, the operation efficiency of the refrigerator may be improved and electricity consumption may be reduced.

The invention claimed is:

1. A refrigerator comprising:

a plurality of evaporators comprising a refrigerating compartment evaporator and a freezing compartment evaporator; and a refrigerant path conversion device connected with the plurality of the evaporators, wherein the refrigerant path conversion device controls a path of refrigerant to perform defrosting operations for predetermined evaporators and cooling operations for the other evaporators, and wherein a first refrigerant path control valve controls a path of the refrigerant drawn into the refrigerating compartment evaporator and the freezing compartment evaporator; and a first bypass pipe provided between the first refrigerant path control valve and the freezing compartment evaporator to guide the refrigerant having passed the first refrigerant path control valve, without being expanded, to the freezing compartment evaporator.

2. The refrigerator as claimed in claim 1, wherein the first bypass pipe is provided between the first refrigerant path control valve and the freezing compartment evaporator, in parallel with a freezing compartment expansion device to expand the refrigerant drawn into the freezing compartment evaporator.

3. The refrigerator as claimed in claim 1, wherein the refrigerant path conversion device further comprises:

a second bypass pipe provided between the freezing compartment evaporator and the refrigerating compartment expansion device that exapands the refrigerant drawn into the refrigerating compartment evaporator to guide the refrigerant discharged from the freezing compartment evaporator to the refrigerating compartment expansion device.

4. The refrigerator as claimed in claim 3, wherein the refrigerant path conversion device further comprises:

a second refrigerant path control valve connected with the second bypass pipe to close the refrigerant flowing to the second bypass pipe selectively.

5. The refrigerator as claimed in claim 4, wherein an end of the second bypass pipe is connected with the second refrigerant path control valve and the other end of the second bypass pipe is connected between the first refrigerant path control valve and the refrigerating compartment expansion device.

6. The refrigerator as claimed in claim 4, wherein the second refrigerant path control valve is a 3-way valve that guides the refrigerant discharged from the evaporator of the freezing compartment toward the second bypass pipe and a compressor selectively.

7. The refrigerator as claimed in claim 1, wherein the first refrigerant path control valve is a 4-way valve.

8. A control method of the refrigerator as claimed in claim 1 comprising:

determining whether a cool air generation operation for the plurality of evaporators is performed or both a cool air generation operation and a defrosting operation are performed simultaneously;

expanding and guiding the refrigerant toward the refrigerating compartment evaporator after drawing refrigerant into the freezing compartment evaporator without the refrigerant being expanded, if it is determined that both the cool air generation operation and the defrosting operation are performed simultaneously.

9. The control method as claimed in claim 8, wherein the refrigerant discharged from the refrigerating compartment evaporator is expanded by an expansion device and the refrigerant is drawn into the evaporator.

10. The control method as claimed in claim 8, wherein the refrigerant drawn into the freezing compartment evaporator passes a condenser and the refrigerant, without passing an expansion device, is bypassed toward the evaporator.

11. The control method as claimed in claim 8, wherein:

the first refrigerant path control valve is provided at a branched portion between a pipe connected with a freezing compartment expansion device connected with the freezing compartment evaporator and a refrigerating expansion device connected with the refrigerating compartment evaporator;

the first bypass pipe is connected with the first refrigerant path control valve, in parallel with the freezing compartment expansion device to guide the refrigerant having passed the first refrigerant path control valve toward the freezing compartment evaporator, without being expanded, wherein the refrigerator further comprises:

a second bypass pipe provided between an outlet pipe of the freezing compartment evaporator and an inlet pipe of the refrigerating compartment expansion device to guide the refrigerant discharged from the freezing compartment evaporator toward the refrigerating compartment expansion device; and a second refrigerant path control valve provided at a connection portion between the second bypass pipe and the outlet pipe of the freezing compartment evaporator to close a flow of the refrigerant selectively, wherein, if the cool air generation operation and the defrosting operation are performed simultaneously, the first refrigerant path control valve controls the condensed refrigerant toward the first bypass pipe to perform the defrosting operation for the evaporator and the second refrigerant path control valve controls the refrigerant discharged from the freezing compartment toward the second bypass pipe.

12. The control method as claimed in claim 11, wherein if only the cool air generation operation for the freezing compartment evaporator is performed, the first path control valve controls the refrigerant toward the freezing compartment expansion device, closing the flow of the refrigerant toward the refrigerating compartment expansion device, and the second refrigerant path control valve controls the refrigerant discharged from the freezing compartment evaporator toward the compressor, closing the flow of the refrigerator toward the second bypass pipe.

13. The control method as claimed in claim 11, wherein if only the cool air generation operation for the refrigerating compartment evaporator is performed, the first refrigerant path control valve controls the refrigerant toward the refrigerating compartment expansion device, closing the flow of the refrigerant toward the freezing compartment expansion device and the second bypass pipe.

14. The control method as claimed in claim 11, wherein if the cool air generation operations for both the refrigerating compartment evaporator and the freezing compartment refrigerator evaporator are performed simultaneously, the first refrigerant path control valve controls the refrigerant toward the freezing compartment expansion device and the second refrigerant path control valve controls the refrigerant discharged from the freezing compartment evaporator to flow toward the second bypass pipe.

15. A refrigerator comprising:

a refrigerating compartment evaporator that generates cool air drawn into a refrigerating compartment;

a freezing compartment evaporator that generates cool air drawn into a freezing compartment;

a refrigerating compartment expansion device that expands the refrigerant drawn into the refrigerator compartment evaporator;

a freezing compartment expansion device that expands the refrigerant drawn into the freezing compartment evaporator; and a refrigerant path conversion device that controls a flow direction of the refrigerant drawn into the refrigerating compartment evaporator and the freezing compartment evaporator to perform a defrosting operation for the freezing compartment evaporator and a cool air generation operation for the refrigerating compartment evaporator, wherein the refrigerant conversion device comprises:

a first refrigerant path control valve that controls the refrigerant to selectively flow to the refrigerating compartment expansion device and the freezing compartment expansion device; and a first bypass pipe provided between the first refrigerant path control valve and the freezing compartment evaporator, in parallel with the freezing compartment expansion device, to guide the refrigerant to the refrigerating compartment evaporator, without the refrigerant passing the freezing compartment expansion device, such that the refrigerant performs a defrosting operation for the freezing compartment evaporator.

16. The refrigerator as claimed in claim 15, wherein the refrigerant path conversion device further comprises:

a second bypass pipe provided between the freezing compartment evaporator and the refrigerating compartment expansion device to guide the refrigerant discharged from the freezing compartment evaporator toward the refrigerating compartment expansion device; and a second refrigerant path control valve connected with the second bypass pipe to close the path of the refrigerant guided by the second bypass pipe selectively.

17. The refrigerator as claimed in claim 16, wherein the first refrigerant path control valve is a 4-way valve and the second refrigerant path control valve is a 3-way valve.

* * * * *